US010378531B2

(12) United States Patent
Su

(10) Patent No.: US 10,378,531 B2
(45) Date of Patent: Aug. 13, 2019

(54) NON-BEAM PUMPING UNIT DRIVEN BY A MOTOR REDUCTION UNIT

(71) Applicant: Zhishen Su, Heilongjiang (CN)

(72) Inventor: Zhishen Su, Heilongjiang (CN)

(73) Assignee: Daqing Dannuo Petroleum Technology Development Co., Ltd., Daqing, Heilongjiang (CN)

( * ) Notice: Subject to any disclaimer, the term of this patent is extended or adjusted under 35 U.S.C. 154(b) by 184 days.

(21) Appl. No.: 15/658,398

(22) Filed: Jul. 25, 2017

(65) Prior Publication Data

US 2018/0163714 A1 Jun. 14, 2018

(30) Foreign Application Priority Data

Dec. 14, 2016 (CN) ..... 2016 1 367195

(51) Int. Cl.

| | |
|---|---|
| ***E21B 43/12*** | (2006.01) |
| ***F04B 47/02*** | (2006.01) |
| ***F04B 47/14*** | (2006.01) |

(52) U.S. Cl.

CPC ..... *F04B 47/02* (2013.01); *E21B 43/126* (2013.01); *F04B 47/14* (2013.01)

(58) Field of Classification Search

CPC ..... E21B 43/126; E21B 43/127; F04B 47/02; F04B 47/14

See application file for complete search history.

(56) References Cited

U.S. PATENT DOCUMENTS

| | | | | |
|---|---|---|---|---|
| 10,184,467 | B2 * | 1/2019 | Su | F04B 47/02 |
| 10,233,985 | B2 * | 3/2019 | Su | F16D 63/006 |
| 2014/0241918 | A1 * | 8/2014 | Xiang | E21B 43/126 417/411 |
| 2016/0245276 | A1 * | 8/2016 | Robison | E21B 43/127 |
| 2016/0273323 | A1 * | 9/2016 | Liu | F04B 47/028 |
| 2018/0156318 | A1 * | 6/2018 | Su | F16H 7/14 |
| 2018/0163714 | A1 * | 6/2018 | Su | F04B 47/02 |

* cited by examiner

*Primary Examiner* — Kenneth L Thompson

(57) ABSTRACT

The utility belongs to the field of the non-beam pumping unit, specifically relating to a non-beam pumping unit driven by a motor reduction unit. The non-beam pumping unit driven by a motor reduction unit comprises a base, a tower body and a drive mechanism. The drive mechanism is mounted on the platform, comprising a motor reduction unit, a large roller, a small roller, a belt and a counterweight device. The motor reduction unit drives the large roller to rotate by a coupling, and one end of the belt is connected with a beam hanger and the other end hangs down after wrapping around the large roller and the small roller from the upper side and then connected with the counterweight device. The motor reduction unit is composed of a motor and a planetary gear reducer in series.

4 Claims, 4 Drawing Sheets

NON-BEAM PUMPING UNIT DRIVEN BY A MOTOR REDUCTION UNIT

BACKGROUND OF THE INVENTION

1. Field of the Invention

The utility belongs to the field of the non-beam pumping unit, specifically relating to a non-beam pumping unit driven by a motor reduction unit.

2. Description of the Related Art

In the petroleum exploitation, the pumping unit is one of the most commonly used oil extraction equipment and most of the pumping units used in the prior art are beam pumping units. There are problems like low mechanical transmission efficiency, high power consumption, difficulty in maintenance and high fault rate in beam pumping units due to their physical structures. To solve these problems, researchers have developed a non-beam pumping unit. The existing non-beam pumping unit typically comprises a base, a tower body mounted on the base and a drive mechanism mounted on a platform at the top of the tower body. The drive mechanism comprises a motor, a roller, a belt and a counterweight device and two ends of the belt are connected with a beam hanger and the counterweight device of the pumping unit respectively. The belt is wrapped around the roller from the upper side of the roller. The motor drives the roller to rotate through the chain so that the beam hanger at both ends of the belt and the counterweight device are moved up and down through driving by the belt, thus achieving the oil pumping of the pumping unit. In the above structure, to ensure high mechanical transmission efficiency and reduce the size of the device, in the design of the non-beam pumping unit, the reduction mechanism in the beam pumping unit is removed and the motor is used directly to drive the roller. As the reducer is removed, the drive structure can only be decelerated by two sprockets with different diameters. The reduction ratio is very small and it is necessary to make up the shortage of the reduction ratio by increasing the motor power to meet the power demands. The high power motor will undoubtedly increase the weight, cost and energy consumption of the pumping unit, to adversely affect the production, transportation and cost control.

SUMMARY OF THE INVENTION

The utility provides a non-beam pumping unit driven by a motor reduction unit to solve the problems proposed in the above-mentioned background art.

The utility solves the technical problems by adopting the following technical solutions: the utility provides a non-beam pumping unit driven by a motor reduction unit, comprising a base, a tower body and a drive mechanism, wherein the base is fixedly mounted on the ground; the lower end of the tower body is hinged on the base, and a pull rod is connected between the tower body and the base and both ends of the pull rod are respectively hinged on the tower body and the base, and the hinge point between the tower body and the base and two end points of the pull rod constitute a triangular supporting structure and the upper end of the tower body is provided with a platform; the drive mechanism is mounted on the platform, comprising a motor reduction unit, a large roller, a small roller, a belt and a counterweight device; the motor reduction unit is connected to the rotating shaft of the large roller and drives the large roller to rotate by a coupling, and one end of the belt is connected with a beam hanger and the other end hangs down after wrapping around the large roller and the small roller from the upper side and then connected with the counterweight device; the motor reduction unit is composed of a motor and a planetary gear reducer in series.

The pull rod is provided with a length adjusting screw. The base is provided with a tower support block, and the tower support block is slidably mounted on the base with a dovetail groove and fixedly connected to the base with a plug pin after the position of the tower support block on the slide is determined; the tower support block is provided with a support rod, and one end of the support rod is hinged on the tower support block and the other end of the support rod is hinged with a toothed plate; the toothed plate is provided with teeth and the tower body is provided with the same teeth paired with the teeth on the toothed plate. The tower body is provided with an angle incidence indicator.

The utility has the following beneficial effects:

1. According to the utility, the motor used in the prior art is replaced with a motor reduction unit. The reducer is introduced in the drive mechanism to effectively increase the speed regulation ratio, thus reducing the requirements for the motor power. The existing reducer in the beam pumping unit is the common gear reducer and the reducer needs to be connected with the power source through the belt drive mechanism; while the belt drive mechanism has a low mechanical transmission efficiency, which is not conducive to the energy saving and improving efficiency. However, the motor reduction unit used in the utility is composed of a motor and a planetary gear reducer in series. In the motor reduction unit, the output shaft of the motor is directly socketed to the power input end of the planetary gear reducer. Compared with the belt drive mechanism, the mechanical transmission efficiency is greatly improved; meanwhile, the reduction mechanism is compact and will not increase the size and weight of the device compared with the existing structure.

2. The tower body is hinged on the base, and the pull rod can be removed during the well repair and the tower body is turned to the horizontal position, to facilitate to make room for the well repair operation. The base is provided with a tower support block which can support the tower body after the tower body is turned over, to prevent the upper end of the tower body from pressing directly on the soft earth, causing the problem of unstable support. For the setting of the support rod, the tower body can be supported in a non-horizontal and non-vertical position to meet various needs of the construction.

3. The pull rod is provided with a length adjusting screw and the angle of inclination of the tower body can be finely adjusted with the length adjusting screw. The angle incidence indicator is used to indicate the angle of inclination of the tower body. The length adjusting screw is rotated while the angle of inclination is viewed to effectively improve the adjustment speed.

Figure 1:
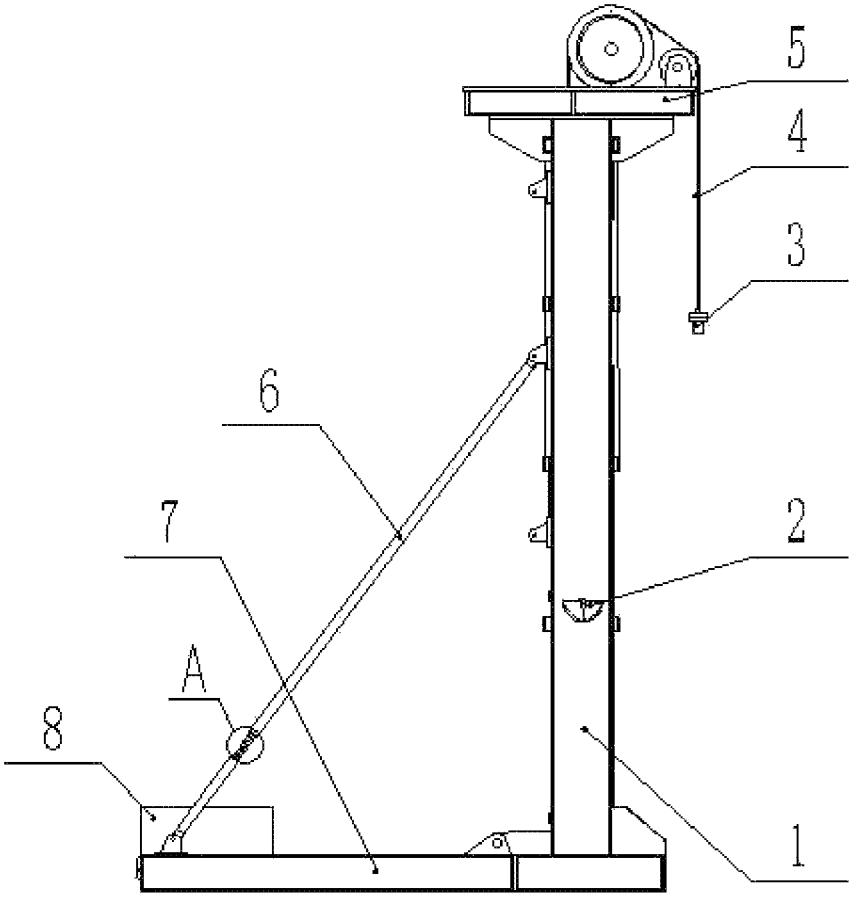
FIG. 1 is a structural schematic diagram of the utility.
Figure 2:
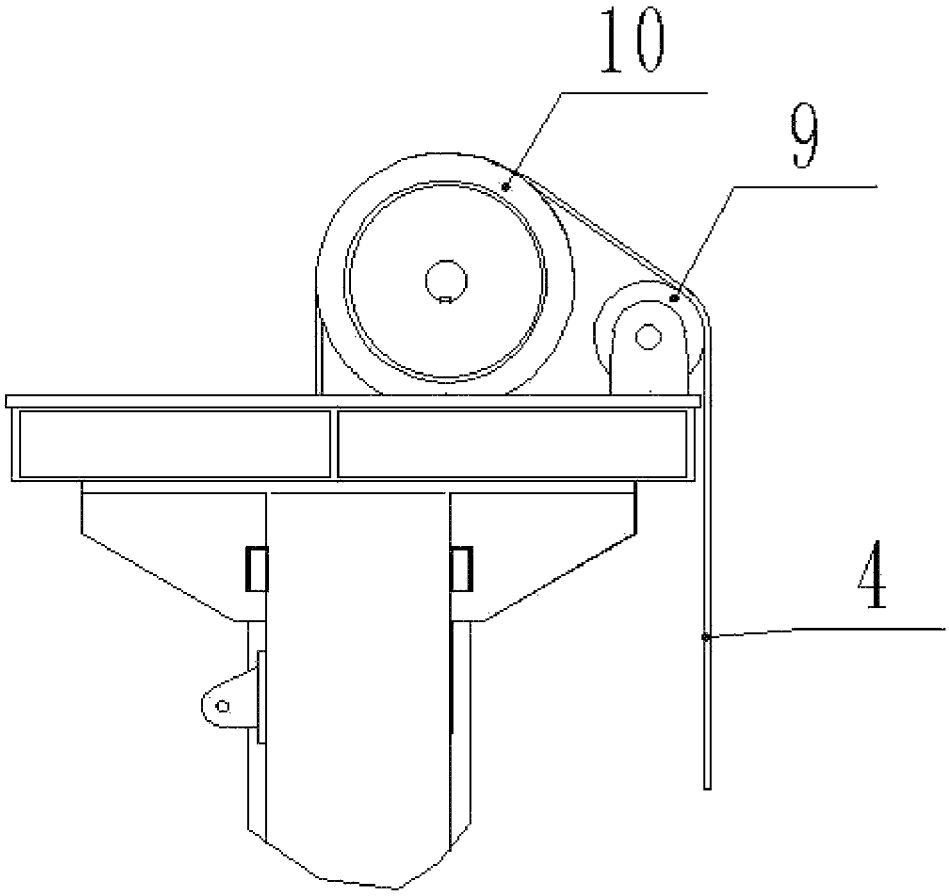
FIG. 2 is a structural schematic diagram of the drive mechanism in FIG. 1.
Figure 3:
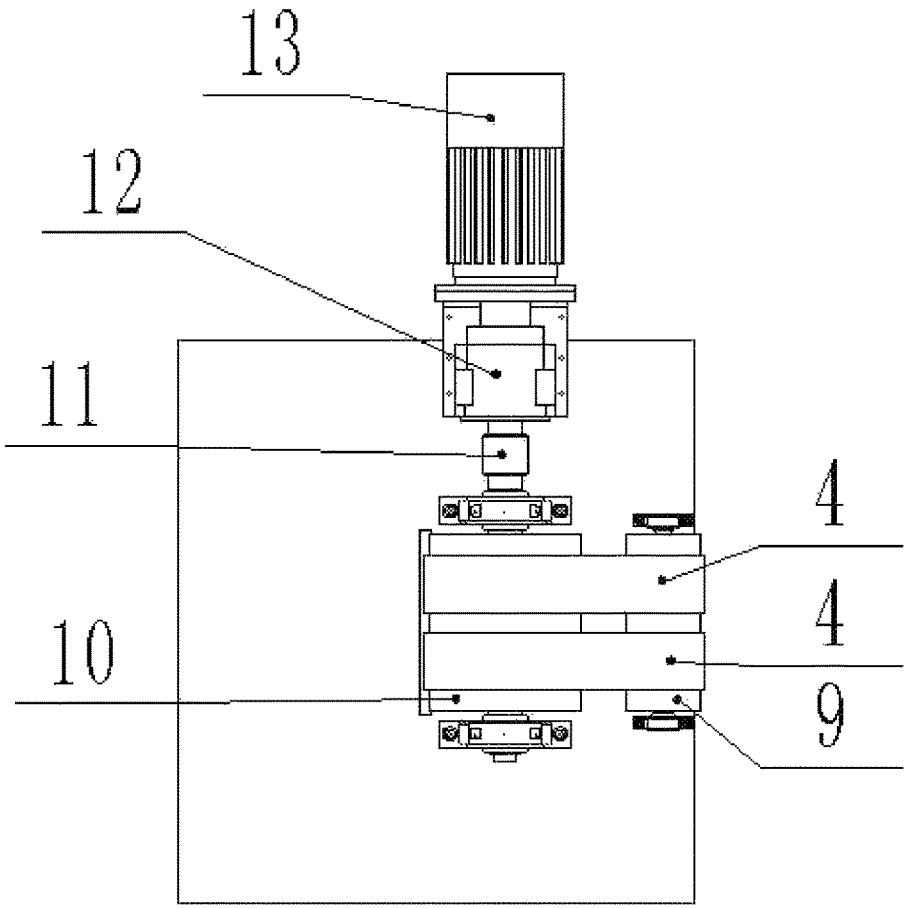
FIG. 3 is a top view of the drive mechanism.
Figure 4:
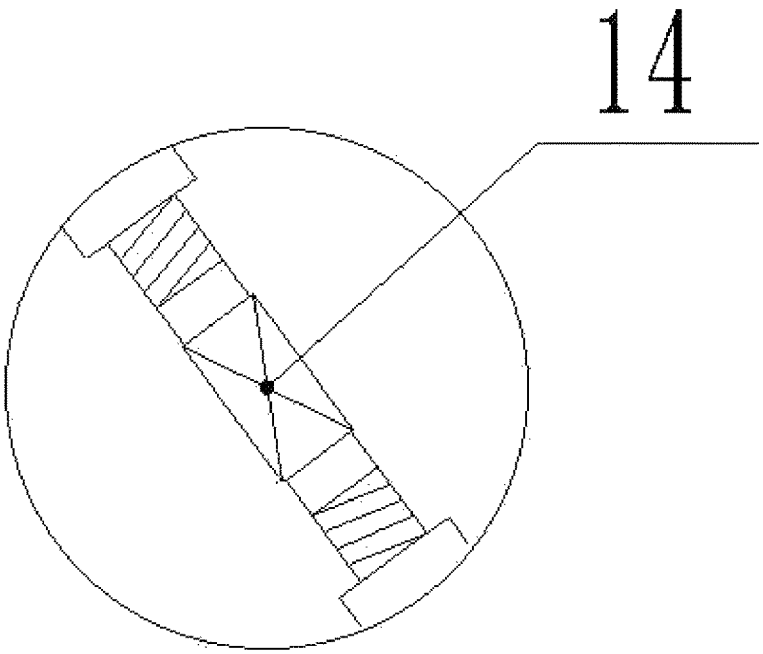
FIG. 4 is a partial enlarged view of A in FIG. 1.
Figure 5:
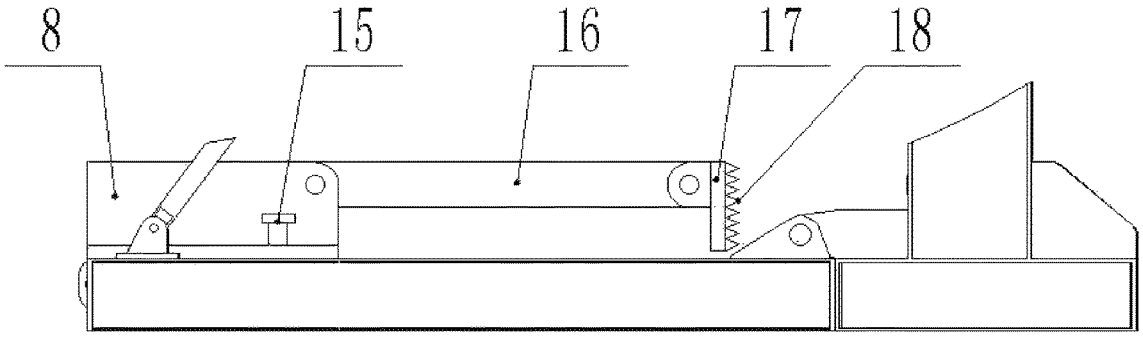
FIG. 5 is a structural schematic diagram of the base in FIG. 1.

In figures: 1—tower body, 2—angle incidence indicator, 3—beam hanger, 4—belt, 5—platform, 6—pull rod, 7—base, 8—tower support block, 9—small roller, 10—large roller, 11—coupling, 12—planetary gear reducer, 13—motor, 14—length adjusting screw, 15—plug pin, 16—support rod, 17—toothed plate, 18—teeth.

DETAILED DESCRIPTION OF THE PREFERRED EMBODIMENTS

The utility is further described as follows with reference to the drawings: According to the embodiment, the non-beam pumping unit driven by a motor reduction unit comprises a base 7, a tower body 1 and a drive mechanism.

The base 7 is fixedly mounted on the ground. The lower end of the tower body 1 is hinged on the base 7, and the pull rod 6 can be removed during the well repair and the tower body 1 is turned to the horizontal position, to facilitate to make room for the well repair operation.

A pull rod 6 is connected between the tower body 1 and the base 7 and both ends of the pull rod 6 are respectively hinged on the tower body 1 and the base 7, and the hinge point between the tower body 1 and the base 7 and two end points of the pull rod 6 constitute a triangular supporting structure, thus ensuring a stable support for the tower body 1.

The upper end of the tower body 1 is provided with a platform 5 and the drive mechanism is mounted on the platform 5. The drive mechanism comprises a motor reduction unit, a large roller 10, a small roller 9, a belt 4 and a counterweight device. The motor reduction unit is connected to the rotating shaft of the large roller 10 and drives the large roller 10 to rotate by a coupling 11, and one end of the belt 4 is connected with a beam hanger 3 and the other end hangs down after wrapping around the large roller 10 and the small roller 9 from the upper side and then connected with the counterweight device (the counterweight device is provided inside the tower body 1 and is not shown in the drawings).

The motor reduction unit is composed of a motor 13 and a planetary gear reducer 12 in series. The motor used in the prior art is replaced with a motor reduction unit. The reducer is introduced in the drive mechanism to effectively increase the speed regulation ratio, thus reducing the requirements for the motor power. The existing reducer in the beam pumping unit is the common gear reducer and the reducer needs to be connected with the power source through the belt drive mechanism; while the belt drive mechanism has a low mechanical transmission efficiency, which is not conducive to the energy saving and improving efficiency. However, the motor reduction unit used in the utility is composed of a motor 13 and a planetary gear reducer 12 in series. In the motor reduction unit, the output shaft of the motor 13 is directly socketed to the power input end of the planetary gear reducer 12. Compared with the belt drive mechanism, the mechanical transmission efficiency is greatly improved; meanwhile, the reduction mechanism is compact and will not increase the size and weight of the device compared with the existing structure.

The tower body 1 is hinged on the base 7. The base 7 is provided with a tower support block 8 which can support the tower body 1 after the tower body 1 is turned 90°, to prevent the upper end of the tower body 1 from pressing directly on the soft earth, causing the problem of unstable support.

The tower support block 8 is slidably mounted on the base 7 with a dovetail groove and fixedly connected to the base 7 with a plug pin 15 after the position of the tower support block 8 on the slide is determined; the tower support block 8 is provided with a support rod 16, and one end of the support rod 16 is hinged on the tower support block 8 and the other end of the support rod 16 is hinged with a toothed plate 17; the toothed plate 17 is provided with teeth 18 and the tower body 1 is provided with the same teeth paired with the teeth 18 on the toothed plate 17. For the setting of the support rod 16, the tower body 1 can be supported in a non-horizontal and non-vertical position to meet various needs of the construction. The angle of inclination of the supported tower body 1 can be adjusted by adjusting the position of the tower support block 8. The toothed plate 17 is engaged with the teeth 18 on the tower body 1 to effectively prevent the slipping, thus ensuring the stability of the support. The toothed plate 17 is hinged to the support rod 16, so that the toothed plate 17 can be parallel to the side of the tower body 1, thus ensuring that all the teeth 18 on the toothed plate 17 can give a full play.

The pull rod 6 is provided with a length adjusting screw 14 and the angle of inclination of the tower body can be finely adjusted with the length adjusting screw 14. The angle incidence indicator 2 is used to indicate the angle of inclination of the tower body 1. The length adjusting screw 14 is rotated while the angle of inclination is viewed to effectively improve the adjustment speed.

The invention claimed is:

1. A non-beam pumping unit driven by a motor reduction unit, comprising a base (7), a tower body (1) and a drive mechanism, wherein the base (7) is fixedly mounted on the ground; the lower end of the tower body (1) is hinged on the base (7), and a pull rod (6) is connected between the tower body (1) and the base (7) and both ends of the pull rod (6) are respectively hinged on the tower body (1) and the base (7), and the hinge point between the tower body (1) and the base (7) and two end points of the pull rod (6) constitute a triangular supporting structure and the upper end of the tower body (1) is provided with a platform (5); the drive mechanism is mounted on the platform (5), comprising a motor reduction unit, a large roller (10), a small roller (9), a belt (4) and a counterweight device; the motor reduction unit is connected to the rotating shaft of the large roller (10) and drives the large roller (10) to rotate by a coupling (11), and one end of the belt (4) is connected with a beam hanger (3) and the other end hangs down after wrapping around the large roller (10) and the small roller (9) from the upper side and then connected with the counterweight device; the motor reduction unit is composed of a motor (13) and a planetary gear reducer (12) in series.

2. The non-beam pumping unit driven by a motor reduction unit according to claim 1, wherein the pull rod (6) is provided with a length adjusting screw (14).

3. The non-beam pumping unit driven by a motor reduction unit according to claim 1, wherein the base (7) is provided with a tower support block (8), and the tower support block (8) is slidably mounted on the base (7) with a dovetail groove and fixedly connected to the base (7) with a plug pin (15) after the position of the tower support block (8) on the slide is determined; the tower support block (8) is provided with a support rod (16), and one end of the support rod (16) is hinged on the tower support block (8) and the other end of the support rod (16) is hinged with a toothed plate (17); the toothed plate (17) is provided with teeth (18) and the tower body (1) is provided with the same teeth paired with the teeth (18) on the toothed plate (17).

4. The non-beam pumping unit driven by a motor reduction unit according to claim 1, wherein the tower body (1) is provided with an angle incidence indicator (2).

* * * * *